US005119982A

United States Patent [19]

Hutzenlaub

[11] Patent Number: 5,119,982

[45] Date of Patent: Jun. 9, 1992

[54] COMPENSATOR FOR A PENDULUM ROLLER

[75] Inventor: Armin Hutzenlaub, Wiehl, Fed. Rep. of Germany

[73] Assignee: Kampf GmbH & Co. Maschinenfabrik, Wiehl, Fed. Rep. of Germany

[21] Appl. No.: 463,029

[22] Filed: Jan. 10, 1990

[51] Int. Cl.[5] ..... B65H 77/00

[52] U.S. Cl. ..... 226/44; 242/75.3

[58] Field of Search ..... 226/24, 25, 29, 30, 226/31, 40, 42, 44, 195; 242/75.43, 75.44, 75.5, 75.51, 75.53, 75.3,75

[56] References Cited

U.S. PATENT DOCUMENTS

| | | | |
|---|---|---|---|
| 3,013,707 | 12/1961 | Beachler | 226/108 |
| 3,974,948 | 8/1976 | Kroppenstedt | 242/75.53 X |
| 4,000,865 | 1/1977 | Gaskins | 242/75.53 X |
| 4,359,178 | 11/1982 | Hayashi et al. | 226/25 |

FOREIGN PATENT DOCUMENTS

| | | |
|---|---|---|
| 724943 | 7/1942 | Fed. Rep. of Germany . |
| 1804590 | 5/1970 | Fed. Rep. of Germany . |

*Primary Examiner*—Daniel P. Stodola
*Assistant Examiner*—Paul T. Bowen
*Attorney, Agent, or Firm*—Herbert Dubno

[57] ABSTRACT

A compensator for small deflections of a pendulum roller on a web process machine includes a tension device which is pivotally connected to a pendulum arm and is, in turn, pivotally connected to a holder above the pendulum axis.

6 Claims, 2 Drawing Sheets

COMPENSATOR FOR A PENDULUM ROLLER

FIELD OF THE INVENTION

My present invention relates to a compensator for small deflections of a pendulum roller on a web-treatment or web-processing machine, frequently referred to herein as a winding machine because the web is normally unrolled from a previously wound roll or is taken up (wound) on a roll in such a machine, usually proximal to the pendulum roller.

BACKGROUND OF THE INVENTION

A pendulum roller is a roller mounted on an arm assembly capable of enabling that roller to swing at least limitedly about a pivot axis located above the roller and at a distance from the axis of the roller determined by the length of the arm means.

The arm means can, for example, comprise a pair of arms connected to the roller at opposite ends thereof and swingably mounted so as to pivot about a common pivot axis.

The roller may be rotatable and the web can pass around the roller.

Such pendulum rollers serve to compensate for variations in web tension which are substantially unavoidable in a winding process, whether that winding process involves a take-up of the web or a delivery of the web from a previously wound roll thereof The web passes in a compensating loop which lengthens or contracts against the roller and thus causes the deflection thereof angularly about the pivot axis in the manner described so as to suppress pulsations in the web and render the web travel more quiescent.

The pendulum roller is urged in one angular direction or sense by the tension on the web and can be biased in the opposite direction by a fluid pressure cylinder acting on the arms, for example, to apply the requisite tension to the web.

It has been found that, especially with low web tensions and thin webs, the intrinsic weight of the pendulum roller can create problems since the intrinsic weight on small deflections contributes a restoring force urging the pendulum roller back into a dead-center position and contributing a force to the web which may be undesired.

The obvious way of eliminating this problem, of course, is to make the weight of the pendulum roller as small as possible so that the restoring force effect of this weight can be minimized. In practice, however, this does not constitute a practical solution, since the pendulum roller must have a significant axial length for very wide webs and a sufficient diameter to provide satisfactory guidance of the web.

Accordingly, the pendulum roller may have dimensions which cannot readily be limited.

OBJECTS OF THE INVENTION

It is the principal object of the present invention to provide an improved pendulum roller assembly which enables compensation for the weight of the pendulum roller, especially with small deflections of the roller out of its dead-center position Another object of the invention is to provide a web processing machine, e.g. involving coiling and uncoiling of the web, having an improved tension compensator in the form of a pendulum roller whereby drawbacks of the prior art are avoided.

SUMMARY OF THE INVENTION

These objects and others which will become apparent hereinafter are attained, in accordance with the invention, by providing a tension device for the pendulum roller of a web processing machine which can substantially compensate for the restoring moment resulting from the pendulum roller weight. With small deflections of the pendulum roller, the restoring moment of torque contributed by the weight of the pendulum roller can be completely eliminated as a consequence of the geometry of the device The pendulum roller assembly of the invention can thus comprise:

a support;

a roller around which a web passes and swingable on the support for compensating changes in tension in the web;

pendulum-arm means pivotally connected to the support for pendulum movement about a first axis at one location and carrying the roller at a second location below the first location, the roller being rotatable on the pendulum-arm means about a second axis;

a holder located on the support above the first axis; and a tension device articulated to the arm and pivotally connected to the holder for pivotal movement about a third axis, the tension device applying tension to the pendulum-arm means taking up weight of the pendulum-arm means and the roller.

In an especially advantageous embodiment of the invention, the tension device is formed as a fluid pressure cylinder.

According to another feature of the invention, which contributes to especially reliable effectiveness of the tension device, the tension device is set to provide a constant tension force this constant tension force can have a fixed ratio of the weight of the pendulum roller.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 2:
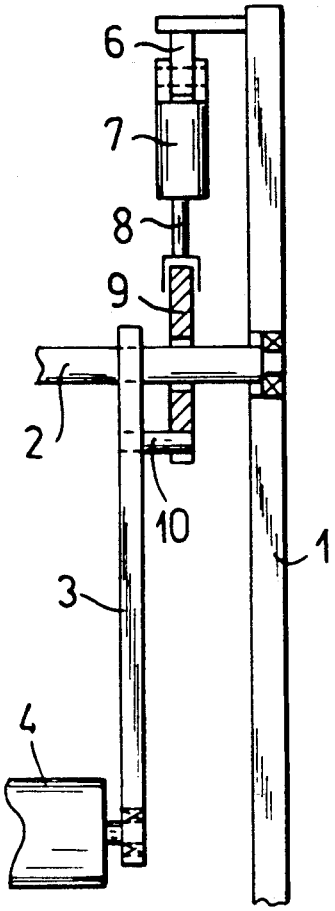
FIG. 2 is a partly broken away side elevational view of the device of FIG. 1.
Figure 1:
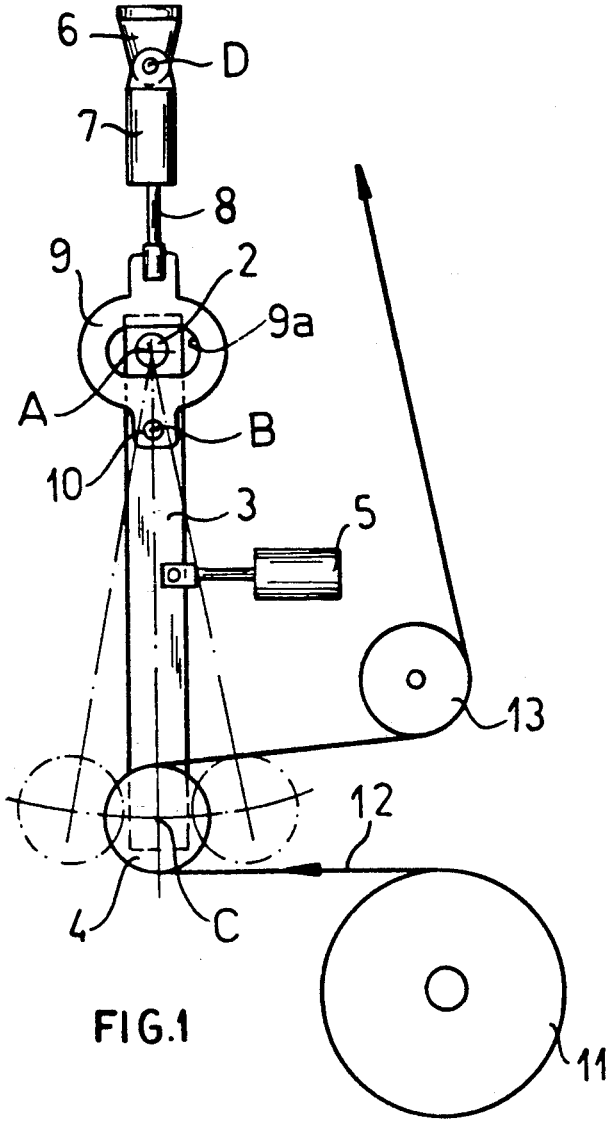
FIG. 1 is a schematic elevational view showing a pendulum roller as used in the web processing machine in conjunction with a delivery roll supplying the web.

Flanking the path of the web 12 of a fabric, paper or other material in a winding machine and especially an unwinding machine, are plates 1, only one of which has been illustrated in FIGS. 1 and 2. The opposite plate is not shown. Plates 1 form a support on which a holder 6 is mounted.

In the plate 1 a shaft pivot 2 is mounted and extends the full width of the web transversely to the path of the latter. This pivot shaft 2 defines a first pivot axis A about which pendulum arms 3 (only one of which is shown) are swingable. The pendulum arm on the opposite side has not been illustrated Between the pendulum arm 3, a pendulum roller 4 is mounted so as to be rotatable about a second axis C.

The pendulum arm 3 is biased in a clockwise sense by a force generating device in the form of a fluid pressure cylinder 5 to generate the desired tension in the web 12 which forms a loop around the pendulum roller 4.

Vertically above the axis A, a holder in the form for holding eye 6 is mounted and defines a third pivot axis D for a fluid pressure cylinder 7.

The piston rod 8 of the fluid pressure cylinder 7 is rigidly connected to a coupling member or link 9 which, in turn, is articulated at the pivot 10 to the arms 3. The pivot axis of the pivot lo between the connecting member 9 and the cylinder 7, 8 is shown at B and extends parallel to the axes A, C, D.

Member 9 is so formed that it allows movement of the arms 3 without being inhibited by the shaft 2. For this purpose, an elongated window 9*a* receiving the shaft 2 with all around clearance, is provided in the connecting member 9.

The web 12 is supplied by a delivery roll 11 and passes around the pendulum roller 4 in a loop extending through 180° of arc around the pendulum roller. The web 12 then passes around a deflection roller 13 to the next web processing station, e.g. a cutting station which cuts the web into predetermined sections The pendulum roller 4 pivots about the axis A through small angular movements and thus compensates for fluctuations in web tension and suppresses so called pulsations of the belt delivered by the roll.

Upon such deflection movements of the pendulum roller 4, a restoring torque or force is established which contributes to respective movement of the pendulum roller 4 so that, under certain circumstances, the pendulum roller 4 may disengage from the belt and cause the pulsations thereby to be amplified.

This is especially the case with low belt tensions using this belt.

Because of a large width of the web, the pendulum roller has a large axial length which can be of several meters and thus a significant weight which can exceed 1000N, so that with small angular deflections of about 5°, for example, restoring forces of about 100N can be superimposed on the restoring force. The restoring force can thereby exceed belt tensions very readily.

The pressurized fluid cylinder 7 can be pressurized with a pressure P which is upwardly effective to exert tension on the arms 3.

Figure 3:
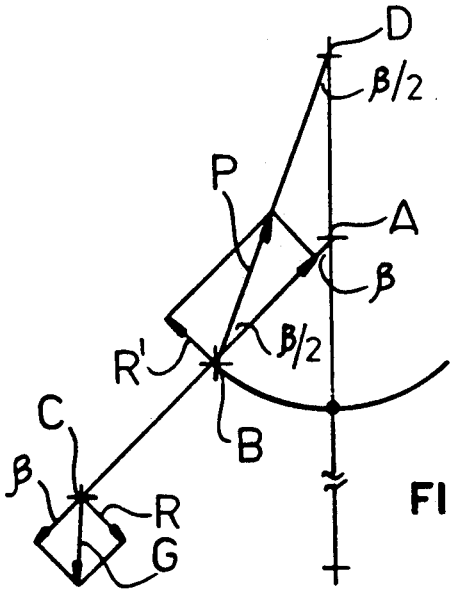
FIG. 3 is a diagram of the kinematic relationship of the parts of the apparatus shown in FIGS. 1 and 2.
Figure 1A:
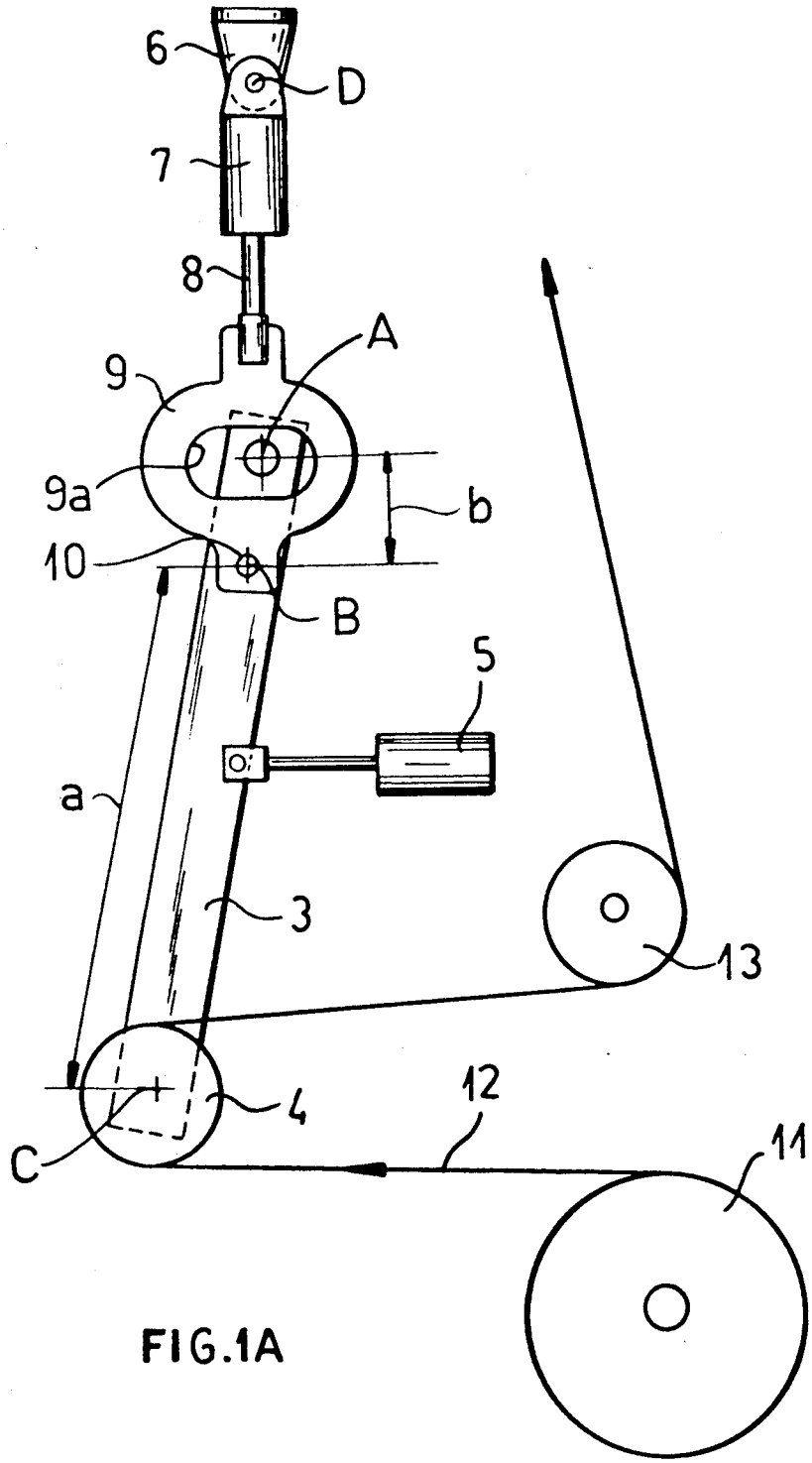
FIG. 1*a* similar to FIG. 1 but showing an extreme position of the roller.

The resulting restoring force or moment can be calculated from the kinematic diagram of FIG. 3. To simplify the calculation the distance $\overline{AD}=b$ is assumed to be equal to the distance $\overline{AB}=b$. FIG. 3 shows the deflection angle $\beta$ of the pendulum roller. With the given geometry, the angle defined between the piston rod 8 and the vertical and the pendulum arms 3 has a value $\beta/2$. The pendulum assembly itself has the length $\overline{AC}=a$. The weight of the pendulum is G.

As a consequence, the restoring torque or moment of the pendulum is:

$$R = a\,G \sin \beta \qquad (1)$$

The restoring torque R is effective opposite the compensation torque R′ which is defined by the relationship:

$$R' = b\,P \sin (\beta/2) \qquad (2)$$

Equation 1 can be transformed as follows (using the half-angle formula $\sin \beta = 2 \sin (\beta/2) \cos (\beta/2)$):

$$3\,R = 2\,a\,b\,G \sin (\beta/2) \cos (\beta/2) = 2\,a\,G \sin (\beta/2) \qquad (3)$$

for small angles, where cosine $(\beta/2)$ can be set to equal 1. As a consequence, since the compensation torque R′ must compensate the restoring torque R:

$$P = \frac{2aG}{b} = KG. \text{ (where } K = 2a/b) \qquad (4)$$

For small deflection angles, it is possible to apply a tension force P which is a constant value independent from the deflection angle since the equation (4) no longer contains an angle component as a term.

For the calculations, the distances $\overline{AD}=\overline{AB}$. This only has been done to simplify the calculations. For other distances and hence distance ratios, a different value is required only for the constant K.

The invention thus provides a comparatively simple device for complete compensation of the restoring torque of the pendulum roller 4 for small deflection angles. The deflection angles are normally so small that the compensation is substantially complete. For larger deflection angles, a substantial portion of the restoring torque or moment resulting from the weight of the pendulum roller 4 is compensated. The tension force developed in the cylinder 7 for the piston rod 8 is set once for a given pendulum roller system utilizing the equation (4).

I claim:

1. A pendulum-roll assembly for a web-processing machine, comprising:

a support;

pendulum-arm means pivotally connected to said support for pendulum movement about a first axis at a first location;

a roller around which a web passes and swingable on said support for compensating changes in tension in said web, said roller being carried on said pendulum-arm means at a second location below said first location, said roller being rotatable on said pendulum-arm means about a second axis;

a holder located on said support above said first axis; and a tension device connected to said pendulum arms means and pivotally connected to said holder for pivotal movement about a third axis, said tension device applying tension to said pendulum-arm means taking up weight of said pendulum-arm means and said roller, said tension device including a fluid-responsive cylinder connected on one end of said holder vertically positioned above said first axis and a link pivotally connected to said pendulum-arm means between said first and second locations, and an end of said link being connected to a second end of said fluid-responsive cylinder.

2. The pendulum-roll assembly defined in claim 1, further comprising a force-generating device connected to said pendulum-arm means for applying a force thereto in a direction opposite a force applied to said pendulum-arm means by a loop of said web passing around said roller.

3. The pendulum-roll assembly defined in claim 2 wherein said force-generating device is a second fluid-responsive cylinder.

4. The pendulum-roll assembly defined in claim 3 wherein said second fluid-responsive cylinder is pivotally connected to said pendulum-arm means between said locations.

5. The pendulum-roll assembly defined in claim 1 wherein said tension device exerts a constant tension on said pendulum-arm means.

6. The pendulum-roll assembly defined in claim 5 wherein said pendulum-arm means is pivotally connected to said support by a shaft extending parallel to said roller and said axes, said link being formed with a window passing said shaft with clearance, said fluid-responsive cylinder having a piston fixed to said link and a cylinder member pivotally connected to said holder.

* * * * *